United States Patent [19]

Petzl et al.

[11] Patent Number: 4,734,834

[45] Date of Patent: Mar. 29, 1988

[54] COMPACT WATERPROOF LIGHTING LAMP WITH ADJUSTABLE LIGHT BEAM

[75] Inventors: Paul Petzl, St. Vincent De Mercuze; Pierre Petzl, St. Nazaire les Eymes, both of France

[73] Assignee: Petzl S.A., Brignoud, France

[21] Appl. No.: 42,426

[22] Filed: Apr. 24, 1987

[30] Foreign Application Priority Data

Apr. 30, 1986 [FR] France ..... 86 06435

[51] Int. Cl.[4] ..... F21L 7/00

[52] U.S. Cl. ..... 362/187; 362/103; 362/105; 362/204; 200/60

[58] Field of Search ..... 362/187, 103, 105, 204, 362/205, 206, 277; 200/60

[56] References Cited

U.S. PATENT DOCUMENTS

| | | | |
|---|---|---|---|
| 1,932,102 | 10/1933 | Eaton . | |
| 4,429,351 | 1/1984 | Petzl | 362/187 |
| 4,577,263 | 3/1986 | Maglica | 362/187 |

FOREIGN PATENT DOCUMENTS

| | | | |
|---|---|---|---|
| 1174733 | 3/1959 | France | 362/187 |
| 2009032 | 5/1968 | France | 362/187 |
| 2372382 | 6/1978 | France | 362/187 |
| 146987 | 5/1931 | Switzerland | 362/187 |
| 1447514 | 8/1976 | United Kingdom | 362/187 |
| 2107038 | 4/1983 | United Kingdom | 362/187 |

*Primary Examiner*—Ronald B. Cox

*Attorney, Agent, or Firm*—Stevens, Davis, Miller & Mosher

[57] ABSTRACT

A portable lamp, especially for mounting on the head of the user, includes an adjustment collar designed to ensure displacement of the reflector causing a variation of the light beam focus, and operation of the bulb switch. The lamp comprises a single casing having an insulating body subdivided by an intermediate wall into a first rear compartment housing the power supply unit, and a second front compartment housing the bulb and the adjustable focusing device. The wall is provided with a communication orifice between the two adjacent compartments, and with a fixed sleeve to house the bulb. The switch is composed of an elastic contact blade cooperating with a flange of the reflector. Refer to FIG. 1.

8 Claims, 4 Drawing Figures

COMPACT WATERPROOF LIGHTING LAMP WITH ADJUSTABLE LIGHT BEAM

BACKGROUND OF THE INVENTION

The invention relates to a portable lighting lamp, notably front-fixing, comprising:

- an electric bulb housed inside a reflector to emit a light beam through a transparent screen,
- a direct current power source comprising a positive pole and a negative pole electrically connected to the bulb by a current supply system,
- an adjustment collar designed to ensure displacement of the reflector to cause a variation in the light beam focus, and operation of the bulb switch.

French Patent No. 2,513,740 describes a lighting lamp wherein the battery power source is located in an auxiliary casing independent from the main casing housing the variable-focus lighting system. An electric supply wire is arranged between the battery and the bulb switch, passing through an orifice in the main casing. The auxiliary casing is disposed at the rear of the user's head, and is connected to the main casing by the elastic strap fixing device, to which the power supply wire is fastened. The structure of a lamp of this kind with two independent casings makes it complicated to manufacture and increases the dimensions and the assembly time. The lack of waterproofing of the main casing may in addition contribute to faulty operation and premature wear of the lighting system when the lamp is used in a damp environment, notably in pot-holing.

BRIEF SUMMARY OF THE INVENTION

The object of the invention is to achieve a compact waterproof lighting lamp allowing simplified operation of the switch and combined focus adjustment of the light beam emitted by the bulb.

The lamp comprises a single casing having an insulating body subdivided by an intermediate wall into a first rear compartment housing the power supply unit, and a second front compartment housing the bulb and the adjustable focusing device, the volume of the second compartment being variable when said collar is actuated manually.

The intermediate wall is provided with a communication orifice between the two adjacent compartments and with a fixed sleeve extending axially in the second front compartment opposite the orifice to house the bulb.

The switch is composed of a first elastic contact blade arranged in said orifice of the wall, and cooperating with a flange associated with the reflector, said blade being secured to a fixing point on the intermediate wall, and comprising a contact part urged by elasticity against the bulb contact stud in the closed position of the switch, and an opposite connection part located in the first rear compartment and in electrical connection with one of the poles of the power supply unit.

Incorporating the power supply unit and the lighting system in a single casing eliminates the need for an external electric connecting wire and enables the adjustment collar waterproofing device to be improved.

The switch is operated by a flange formed by a cylindrical bush fixed to the reflector in such a way as to coaxially surround the sleeve housing the fixed bulb. A first elastic contact blade of the switch is actuated by pivoting by the flange at the end of the screwing travel of the adjustment collar.

The flange moves by axial translation in the front compartment and cooperates in the orifice with the middle part of the first contact blade, located between the fixing point and the contact part.

The axial position of the fixed bulb inside the sleeve is perfectly determined by positioning clips which come up against the end of the bulb contact stud. A second contact blade secured to the intermediate wall provides the electrical connection of the contact stud with the other pole of the power supply unit.

The body of the casing comprises a rectangular-shaped rear open end which can be blanked off by a removable cover after the direct current power source has been fitted in the first compartment, and a cylindrical-shaped front open end capped by the rotational reflector position adjustment collar.

One of the ends of the adjustment collar is mounted tightly on the screen, and the other end is provided with an annular protuberance capable of sliding along the cylindrical periphery of the body when the collar is rotationally adjusted.

BRIEF DESCRIPTION OF THE DRAWINGS

Other advantages and features will become more clearly apparent from the following description of an illustrative embodiment of the invention provided in non-restrictive manner and represented in the accompanying drawings in which.

DETAILED DESCRIPTION

Figure 1:
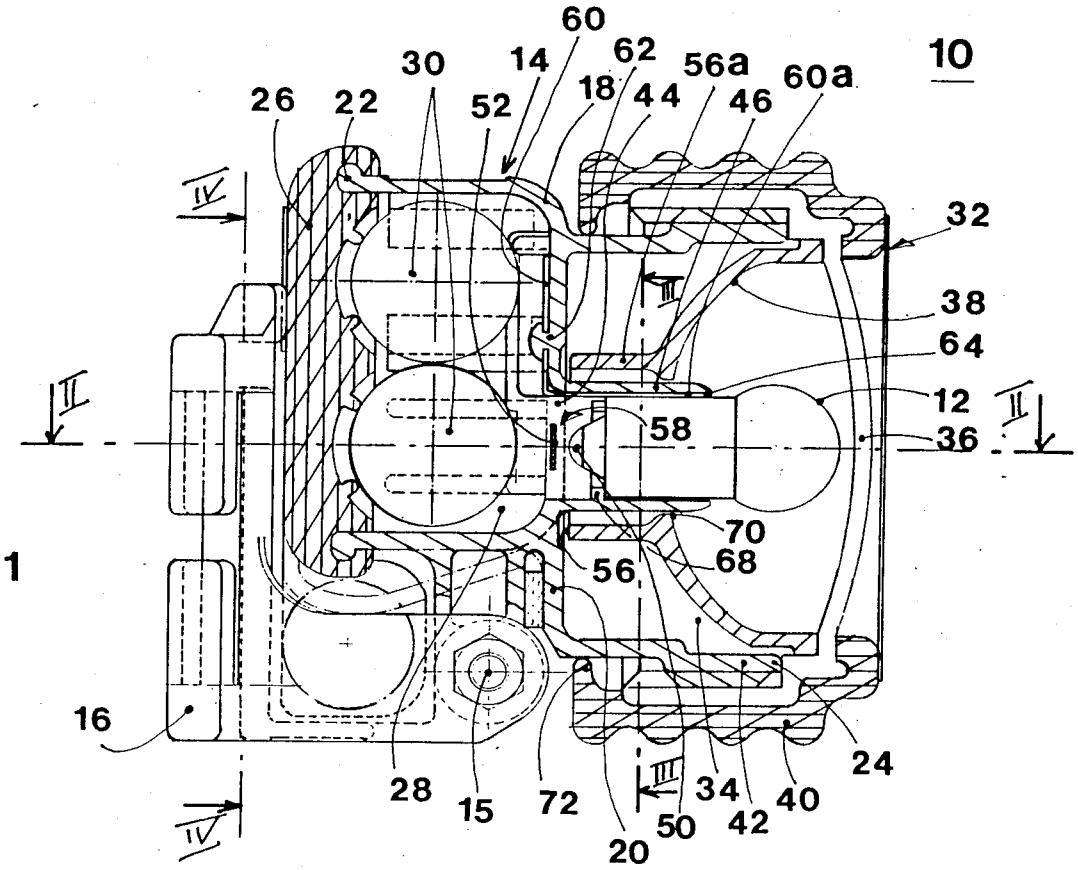
FIG. 1 is an axial section view of the lighting lamp according to the invention, shown at the end of the screwing travel of the adjustment collar corresponding to opening of the switch.

In the figures, a portable lighting lamp 10, notably front-fixing, comprises an electric bulb 12 and a casing 14 made of insulating material, equipped with a mounting bracket 16 with a curved base 17. A flexible attachment system (not shown) by means of an elastic strap is connected to the base 17 of the bracket 16 to provide mounting of the casing 14 on the front of the user's head. The casing 14 is pivotally mounted on a horizontal axis 15 of the bracket 16 so as to ensure that the lamp is oriented vertically.

The body 18 of the casing 14 is fitted with an intermediate partitioning wall 20 with open front 22 and rear 24 ends. The rear end 22 is rectangular and can be blanked off by a removable cover 26 to confine a first rear compartment 28 for housing the batteries 30 of the electric supply unit 31 to the bulb 12. The cylindrical front end 24 is covered by a focusing device 32 to confine a second front compartment 34 in which the bulb 12 is fitted.

The focusing device 32 comprises a transparent cylindrical screen 36 for the light beam to pass through, and a parabolic reflector 38 coaxially surrounding the bulb 12 inside the second compartment 34. The screen 36 and reflector 38 assembly is secured to a rotational collar 40 cooperating by screwing with a threaded cylindrical end 42 of the body 18, causing a variation in the volume of the front compartment 34.

The central part of the intermediate wall 20 comprises an orifice 44 by means of which the two compartments 28, 34 communicate. The wall 20 is provided with a tubular sleeve 46 extending in the front compartment 34 opposite the orifice 44. The insulating sleeve 46 is fixed, and acts as a housing for the metal socket 48 of the bulb 12. The central contact stud 50 is insulated from the socket 48 and cooperates with an end 52*a* of a first contact blade 52 of the direct current power supply unit 31. The opposite end 52*b* of the contact blade 52 is in electrical connection with the positive pole of the battery power source 30, and the intermediate part is fixed by crimping to a fixing point 54 of the separating wall 20. The curved fixed portion of the conducting blade 52 located between the connecting part 52*b* and the fixing point 54 is situated in the first rear compartment 28 following the shape of the insulating body 18 of the casing 14. The other elastic portion of the blade 52 located between the fixing point 54 and the free contact part 52*a* extends in the orifice 44 in a parallel direction to the lower battery 30.

Figure 2:
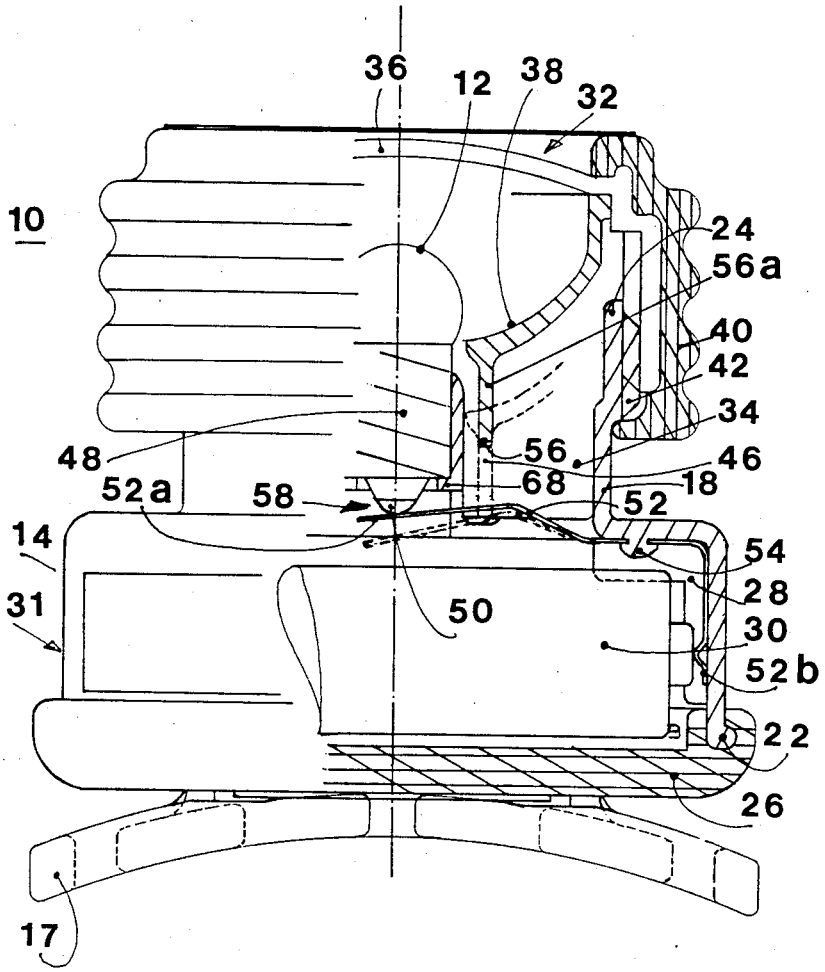
FIG. 2 shows a plan half-view and a sectional half-view along the line II—II of FIG. 1, the switch being represented in the closed position (bold lines) and in the open position (dotted lines)
Figure 3:
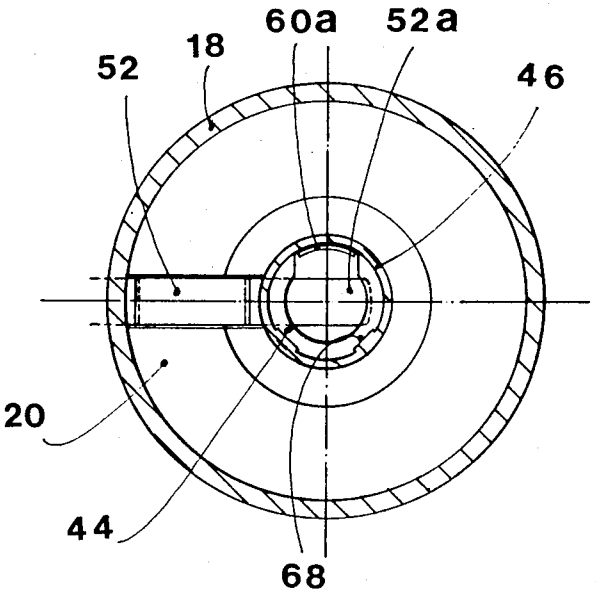
FIG. 3 is a sectional view of the body of the casing, along the line III—III of FIG. 1, with the electric bulb and focusing system removed.

The reflector 38 is equipped with an operating flange 56 capable of actuating the elastic portion of the first contact blade 52 to a cleared position when the adjustment collar 40 reaches the end of screwing travel (FIG. 1 and FIG. 2, in dotted lines). The elasticity of the first contact blade 52 urges the contact part 52*a* into contact with the power supply contact stud 50 of the bulb 12 when the flange 56 of the reflector 38 does not interfere with the blade 52 (FIG. 2, in bold lines).

The switch 58 of the lamp 10 comprises a pair of separable contacts the stationary contact of which is formed by the central contact stud 50 of the bulb 12, and the movable contact by the pivoting contact blade 52. The closed or open state of the switch 58 depends on the relative position of the operating flange 56 actuated manually by the rotational collar 40. The switch 58 is closed during most of the rotational travel of the collar 40 corresponding to the adjustment of the light beam focusing device 32.

Figure 4:
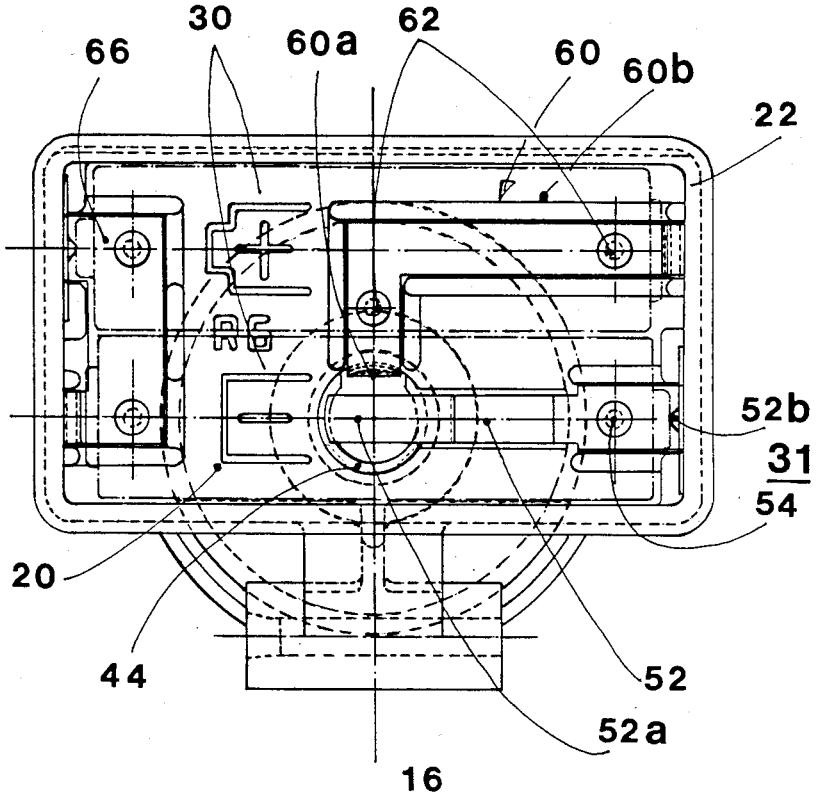
FIG. 4 is a profile view along the line IV—IV of FIG. 1, with the battery power supply unit blanking cover removed.

The negative pole of the power supply unit 31 is electrically connected to the socket 48 of the bulb 12 by a second contact blade 60, fixed to the intermediate wall 20 at two points 62. A branch 60*a* of the second contact blade 60 is inserted without play in a radial clearance 64 arranged between the sleeve 46 and the socket 48. The other opposite branch 60*b* of the blade 60 is electrically connected to the negative pole (FIG. 4). The two cylindrical batteries 30 of the power supply unit 31 are placed in series by an electrical connection 66 (FIG. 4) and extend parallel to one another in the rear compartment 28 in a transverse direction perpendicular to the longitudinal axis of the bulb 12. Inside the insulating sleeve 46, the axial position of the fixed bulb 12 is defined by positioning clips 68 which come up against the end of the cylindrical socket 48.

The first rear compartment 28 is parallelipipedic in shape, and houses the electrical power supply 31 comprising the batteries 30 and the contact blades 52, 60 of the system supplying the current to the bulb 12. The batteries 30 can be replaced after the cover 26 has been removed when the pivoting casing 14 is lowered as far as possible in relation to the bracket 16.

The second front compartment 34 of the casing 14 has a cylindrical shape of variable volume housing the electric bulb 12, the focusing device 32 and the flange 56 operating the switch 58. Operation of the rotational collar 40 brings about adjustment of the light beam of the bulb 12 by translational displacement of the reflector 38, and control of the switch 58 at the end of screwing travel. The flange 56 operating the switch 58 consists of a cylindrical bush 56*a* coaxially surrounding the fixed sleeve 46 of the intermediate wall 20. The insulating bush 56*a* is an integral part of the reflector 38 and extends the latter on the annular collar 70 side opposite from the screen 36. At the end of the screwing travel of the collar 40, the flange 56 cooperates directly with the first contact blade 52 of the switch 58 without any intermediate transmission part.

The rotational collar 40 is tight-mounted on the screen 36, and comprises an annular protuberance capable of sliding along the external cylindrical periphery of the body 18 when the collar 40 is adjusted in rotation. The presence of this protuberance on the rotational collar 40 provides a dynamic sealing device. The collar 40 and cover 26 are made of a flexible material, notably elastomer-based, whereas the rest of the casing 18 is made of undeformable plastic material. The lighting lamp 10 is waterproof.

The bulb 12 is of the standard commercial type, notably of the incandescence or halogen type, having a screw socket 48. A bayonet-socket bulb 12 may naturally be used. The batteries 30 may be replaced by a rechargeable accumulator.

We claim:

1. A portable lighting lamp, especially for mounting on the head of the user comprising:

an electric bulb housed inside a reflector to emit a light beam through a transparent screen, a direct current power source comprising a positive pole and a negative pole electrically connected to the bulb by a current supply system, an adjsutment collar designed to ensure displacement of the reflector to cause a variation in the light beam focus, and operation of the bulb switch, a single casing having an insulating body subdivided by an intermediate wall into a first rear compartment housing the power supply unit, and a second front compartment housing the bulb and the adjustable focusing device, the volume of the second compartment being variable when said collar is actuated manually, the intermediate wall being provided with a communication orifice between the two adjacent compartments and with a fixed sleeve extending axially in the second front compartment opposite the orifice to house the bulb, a first elastic contact blade of the switch arranged in said orifice of the wall, and cooperating with a flange associated with the reflector, said blade being secured to a fixing point on the intermediate wall, and comprising a contact part urged by elasticity against the bulb contact stud in the closed position of the switch, and an opposite connection part located in the first rear compartment and in electrical connection with one of the poles of the power supply unit.

2. The lighting lamp according to claim 1, wherein the flange operating the switch is formed by a bush fixed to the movable reflector in such a way as to coaxially surround the fixed sleeve, and the first elastic contact blade is actuated by pivoting by said flange at the end of the screwing travel of the adjustment collar.

3. The lighting lamp according to claim 2, wherein the flange moves by axial translation in the front compartment and cooperates in the orifice with the middle part of the first contact blade, located between the fixing point and the contact part.

4. The lighting lamp according to claim 1, wherein the internal side wall of the fixed cylindrical sleeve includes positioning clips coming up against the end of the bulb socket, a second contact blade secured to the intermediate wall providing the electrical connection of the socket with the other pole of the power supply uniy.

5. The lighting lamp according to claim 4, wherein a branch of the second contact blade is fitted without play in a radial clearance arranged between the sleeve and the bulb socket.

6. The lighting lamp according to claim 1, wherein the body of the casing includes a rectangular-shaped rear open end which can be blanked off by a removable cover after the direct current power source has been fitted in the first compartment, and a cylindrical-shaped front open end capped by the rotational reflector position adjustment collar.

7. The lighting lamp according to claim 6, wherein one of the ends of the adjustment collar is tightly mounted on the screen, and the opposite end is provided with an annular protuberance capable of sliding along the cylindrical periphery of the body when the collar is adjusted in rotation.

8. The lighting lamp according to claim 1, wherein the power supply unit comprises two batteries arranged side by side and extending parallel to one another in the rear compartment in a transverse direction perpendicular to the longitudinal axis of the bulb.

* * * * *